US005996462A

United States Patent [19]

Gittel et al.

[11] Patent Number: 5,996,462

[45] Date of Patent: Dec. 7, 1999

[54] SLITTING TOOL FOR A CIRCULAR SAW MACHINE AND SLITTING SAW BLADE THEREFOR

[75] Inventors: Hans-Jürgen Gittel, Rottenburg; Julius Friesinger, Horb-Dettingen; Otto Katz, Horb-Bildechingen, all of Germany

[73] Assignee: Ledermann GmbH, Horb am Neckar, Germany

[21] Appl. No.: 08/913,377

[22] PCT Filed: Feb. 23, 1996

[86] PCT No.: PCT/EP96/00747

§ 371 Date: Aug. 25, 1997

§ 102(e) Date: Aug. 25, 1997

[87] PCT Pub. No.: WO96/26815

PCT Pub. Date: Sep. 6, 1996

[30] Foreign Application Priority Data

Feb. 25, 1995 [EP] European Pat. Off. ..... 95102715

[51] Int. Cl.[6] ..... B27G 19/10

[52] U.S. Cl. ..... 83/698.51; 83/676; 83/698.41; 83/863; 144/238

[58] Field of Search ..... 83/676, 698.41, 83/698.51, 698.61, 863, 865; 144/222, 238, 239, 223

[56] References Cited

U.S. PATENT DOCUMENTS 2,788,812 4/1957 Jacobs .
3,323,567 6/1967 Segal .
4,055,204 10/1977 Gunzner et al. ..... 144/238
4,177,685 12/1979 DeLancey .
4,730,962 3/1988 Johannesson .
4,970,927 11/1990 Benuzzi ..... 144/238 X

FOREIGN PATENT DOCUMENTS 0077517 4/1983 European Pat. Off. .
0273200 7/1988 European Pat. Off. .

*Primary Examiner*—M. Rachuba
*Assistant Examiner*—T. Anthony Vaughn
*Attorney, Agent, or Firm*—Robert W. Becker & Associates

[57] ABSTRACT

A slitting tool for a circular saw machine has a tool carrier with a first and second tool flanges arranged coaxially and axially displaceable relative to one another. A slitting saw blade has first and second blade halves. Fasteners are provided for fastening the first blade half in a detachable manner to the first tool flange and for fastening the second blade half in a detachable manner to the second tool flange. The fasteners are distributed circumferentially about the tool carrier. An adjusting device is arranged within the tool carrier and connects the two tool flanges to one another. At least one fastener is arranged in a displaced position relative to other fasteners for balancing the slitting tool, wherein the displaced position is determined according to balancing criteria.

19 Claims, 6 Drawing Sheets

SLITTING TOOL FOR A CIRCULAR SAW MACHINE AND SLITTING SAW BLADE THEREFOR

BACKGROUND OF THE INVENTION

The invention relates to a slitting tool for a circular saw machine, especially for a panel saw, as well as a slitting saw blade therefor.

Such a slitting tool is used especially when a material having a sensitive or brittle cover layer must be cut by a circular saw blade. When performing a cut, the saw teeth of the circular saw blade may exit from the workpiece cover layer at a relatively flat angle so that at the exit area of the saw blade chipping or tearing may occur at the cover layer.

In woodworking shops or finishing shops, a slitting tool is used first for cutting to size especially laminated material panels by panel saws. The slitting tool rotates counter to the direction of rotation of the saw blade. In a first step the slitting tool separates the chipping prone lower cover layer and generates a slitting groove of minimal depth in which the saw blade for separating the material will enter from above when performing the separating cut. In order to produce a straight and chip-free edge at the material panel at the exit side of the saw blade, the center axes of the two tools must be positioned on a single straight line and their cutting widths must be adjusted to one another.

Panel saws are also used for materials with edges that are chip-resisant. In these cases, the slitting tool is pivoted away and only the circular saw blade is used. Accordingly, the circular saw blade is subjected to greater wear and must be sharpened more frequently whereby the cutting width of the circular saw blade changes and the resulting measurement differences must be compensated by a cutting width adjustment of the slitting tool.

Known slitting tools used with panel saws are comprised of two blade halves and spacer rings positioned therebetween whereby the blade halves form the slitting saw blade and are clamped between two flanges on a drive shaft. The adaptation of the cutting width of the slitting tool to the actual cutting width of the circular saw blade is performed by removing or adding one or more spacer rings. In practice, the cutting width of the newly sharpened circular saw blade is first measured. Subsequently, the slitting tool is removed from the drive shaft, dismantled, and the required number of spacer rings are arranged. The blade halves of the slitting tool are then mounted so as to be rotationally and axially secured on the drive shaft. When in a subsequent tryout the width of the cut of the slitting tool does not yet match, the slitting tool must again be removed and disassembled in order to exchange the respective spacer rings to adjust for the deviation. The adaptation of the cutting width is thus time and labor intensive. Moreover, when a plurality of trial cuts are required for the adjustment, a considerable amount of waste material is produced.

From European patent application 0 273 200 a circular saw blade with adjustable cutting width is known in which the blade halves are secured on a respective tool flange. The tool flanges are embodied so as to be of radial symmetry and are adjustable with an exterior adjusting device axially relative to one another so that the cutting width of the circular saw blade can be changed. The entire arrangement, however, is very large especially because of the exterior adjusting device so that it can be used only with difficulty as a slitting tool because of the minimal space available at panel saws.

It is therefore an object of the invention to improve a slitting tool, and a slitting saw blade for such a slitting tool of the aforementioned kind such that for a minimal constructive size an adjusting device for a fast and simple adjustment of the cutting width with respect to a circular saw blade downstream thereof is possible with minimal labor expenditure.

SUMMARY OF THE INVENTION

The slitting tool for a circular saw machine according to the present invention is primarily characterized by:

- a tool carrier comprised of a first and second tool flanges arranged coaxially and axially displaceable relative to one another;
- a slitting saw blade comprised of a first and second blade halves;
- fasteners for fastening the first blade half in a detachable manner to the first tool flange and for fastening the second blade half in a detachable manner to the second tool flange;
- the fasteners distributed in a circumferential direction about the tool carrier;
- an adjusting device arranged within the tool carrier and connecting the first and second tool flanges to one another;
- at least one of the fasteners arranged in a displaced position relative to other fasteners for balancing the slitting tool, wherein the displaced position is determined according to balancing criteria.

The fasteners have a central axis, and the central axes are positioned on a common circle about an axis of rotation of the slitting tool, wherein the central axis of the at least one fastener is positioned at different spacing to the central axes of neighboring fasteners.

The fasteners are preferably screws. The blade halves have through openings, and the tool flanges have threaded bores. The screws penetrate the through openings and engage the threaded bores.

The screws have a countersunk head and the through openings have a cutout. The countersunk heads are positioned in the cutouts of the through openings.

The cutouts are greater than the countersunk heads received therein.

The fasteners of the first blade half are positioned opposite the fasteners of the second blade half, and the central axes of the fasteners positioned opposite one another coincide.

The second tool flange has a hub, and the first tool flange is axially displaceably secured on the hub.

The hub has a rotary follower and the rotary follower engages the first tool flange.

The hub and the second tool flange are separate components whereby the hub has a ringsecond tooling at an outer end face of the second tool flange and fastened to the outer end face.

The adjusting device is a threaded spindle. The second tool flange has a thread-free bore. The threaded spindle penetrates the thread-free bore of the second tool flange in a direction toward the first tool flange. The threaded spindle is rotatable in the thread-free bore and is threaded into the first tool flange.

The threaded spindle has a head and the head rests at an outer end face of the second tool flange facing away from the first tool flange.

The second tool flange has a cover plate and the head is secured rotatably but without play between the cover plate and the outer end face.

The cover plate is an annular flange of the hub.

The invention also concerns a slitting saw blade for a slitting tool of a circular saw machine, wherein the slitting tool comprises two tool flanges axially displaceably connected to one another by an adjusting device. The slitting saw blade according to the present invention comprises two blade halves, each having through openings distributed in a circumferential direction of the saw blade for allowing penetration by fasteners with which each one of the blade halves is securable on one of the two tool flanges of the slitting tool. For balancing the slitting tool, at least one of the through openings in one of the blade halves is positioned in a displaced position relative to the other through openings of the one blade half, wherein the displaced position is determined according to balancing criteria.

The through openings are provided with a cutout at a side facing away from the tool flanges for receiving a head of the fasteners, whereby the cutout is at least slightly greater than the head.

The through openings are positioned on a common circle about an axis of rotation of the slitted saw blade and at least one through opening is positioned at a different spacing to neighboring ones of the through openings.

The through openings have a non-circular cross-sectional contour.

The non-circular cross-sectional contour is slot-shaped, elliptically shaped or bayonet-shaped.

The first tool flange of the slitting tool is axially displaceable relative to the second tool flange, for example, is of a telescopic design whereby via the adjusting device arranged within the tool carrier the two tool flanges can be connected in a positive-locking and frictional connection to one another in the rotational direction. Upon actuation of the adjusting device the axial distance between the two tool flanges is changed. This preferably continuous adjustment can be performed over the entire service life of the slitting tool mounted on the drive shaft so that difficult demounting and mounting labor is eliminated. In a portion of the otherwise needed time, a multiple adjustment is possible in order to ensure an adaptation of the cutting width of the slitting saw blade to the cutting width of the counter-rotating circular saw blade arranged downstream.

The imbalance produced by the arrangement of the adjusting device within the tool carrier can be, for example, compensated by material removal that reduces the imbalance. In order to achieve this, at least one of the fastening means (fasteners) for detachably securing the blade halves to the respective tool flanges is displaced according to imbalance criteria relative to the other fastening means of the same blade half. In this context, advantage is taken of the bores to be provided within the tool flange for receiving the fastening means such that these bores are not completely filled with a fastening means, i.e., in general, are longer than the fastening means. After arrangement of the fastening means securing the saw blade half an effective material removal at the location of each fastening means thus remains which, due to the inventive asymmetric arrangement relative to the axis of rotation, one of the fastening means can thus be used for balancing the slitting tool. By determining the position of the fastening means along the circumference of the tool flanges already during the design of the slitting tool, balancing is provided by this material removal so that with the fastening of the blade halves on the tool flanges, which is necessary in any case, a balanced slitting tool is provided without additional balancing measures after completed mounting of the entire arrangement. The constructive size of the slitting tool can be very small because no additional balancing bores must be provided within the tool carrier. Due to the elimination of the balancing bores, the elements of the tool carrier can be arranged closely to one another without running the risk that the functionally important parts of the adjustable tool carrier are exposed or damaged by balancing bores.

In a simple embodiment, the central axes of the fastening means are positioned on a common circle about the axis of rotation of the slitting tool whereby at least the central axis of one fastening means is positioned at different spacing to the central axes of neighboring fastening means.

In a preferred embodiment of the invention the adjusting device is a threaded spindle. The desired adjusting stroke, which is realized by rotation of the threaded spindle, can be determined in a simple manner by the pitch of the thread so that a fine adjusting or continuous adjustment is possible. The threaded spindle is expediently a threaded bolt which penetrates a threaded bore within the second tool flange in the direction onto the first tool flange whereby the head of the bolt is supported axially at the second tool flange. The first tool flange is axially displaceably secured on a hub of the second tool flange whereby preferably the hub engages with a rotary follower the first, displaceably secured tool half. In this manner, independent of the adjusting stroke, in any axial relative position of the two tool flanges relative to one another a play-free, rotationally fixed connection between the tool flanges is ensured. The telescope-like guiding of the first tool flange on the hub of the second tool flange ensures furthermore that only minimal axial run-out will result.

The slitting saw blade for use with the inventive slitting tool of a circular saw machine is comprised of two blade halves, whereby each blade half comprises openings distributed over the circumference for penetration by the fastening means, with which each blade half is secured on a tool flange, and whereby the axially adjustable tool flanges are displaceably connected relative to one another by an adjusting device. For balancing the entire tool, at least one penetrating opening is positioned about the circumference so as to be displaced relative to the other penetration openings of the same blade half. The position of the asymmetrically arranged penetration opening relative to the axis of rotation of the slitting saw blade is selected according to balancing criteria of the slitting tool for which the slitting saw blade is designed. By themselves, the blade halves of the slitting saw blade have imbalance due to the asymmetric arrangement of the penetration openings. This deliberately provided imbalance serves as the balancing weight for the tool carrier of the slitting tool and compensates the imbalance resulting from the internal adjusting device. After mounting of the blade halves on the tool flanges, the slitting tool itself is balanced. The penetration openings that are non-uniformly distributed about the circumference ensure furthermore that the unbalanced slitting saw blade can be used only with a corresponding unbalanced tool carriers which has matching bores for receiving the fastening means.

Preferably, one penetration opening has at a side facing away from the tool flange a cutout for receiving the head of the fastening means whereby the cutout is at least somewhat greater for completely receiving the head than necessary. In this manner, a material removal providing imbalance is provided which also serves for balancing the entire tool.

BRIEF DESCRIPTION OF THE DRAWINGS

Further features of the invention result from further claims, the description, and the drawing, in which embodiments of the invention are represented which will be explained in the following in detail. It is shown in:

DESCRIPTION OF PREFERRED EMBODIMENTS

Figure 1:
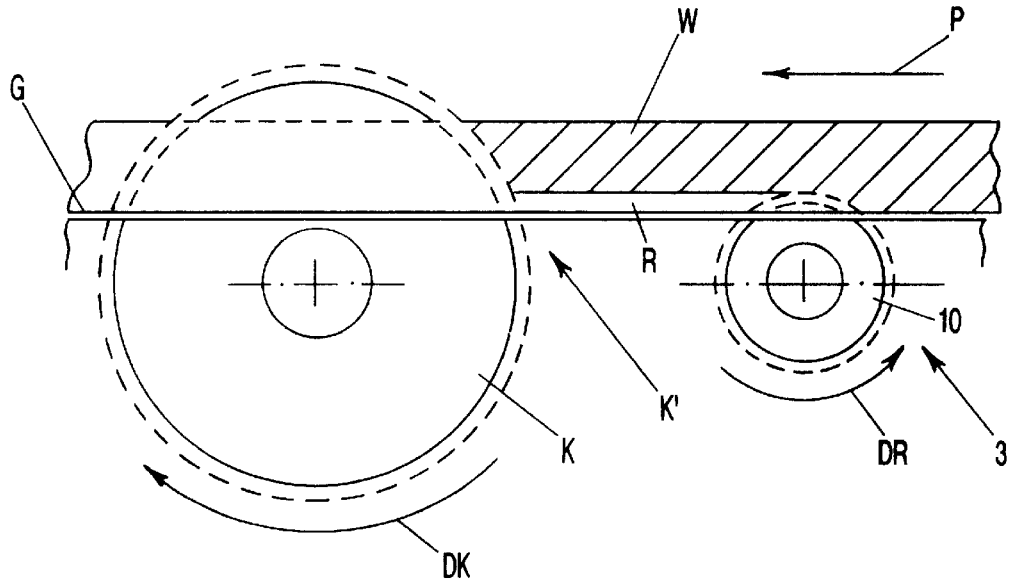
FIG. 1 a schematic representation of a circular saw machine with a slitting tool.

FIG. 1 shows schematically a circular saw machine embodied as a panel saw with a circular saw blade K and a slitting tool 3. The material to be cut, for example, a material panel W coated on both surfaces, is fed in the direction of arrow P to the circular saw machine whereby the slitting saw blade 10 of the slitting tool 3, positioned, for example, beneath the panel W, slits the panel W, i.e., cuts into the panel W but does not perform a separating cut. For performing the separating cut the circular saw blade K is arranged which below the panel W is positioned in a common plane E (FIG. 2) with the slitting saw blade 10. The circular saw blade K extends exactly within the slitting groove R machined by the slitting saw blade 10 so that at the exit side K' of the circular saw blade K separating the panel W ensures a chip-free, straight cutting edge W.

Figure 2:
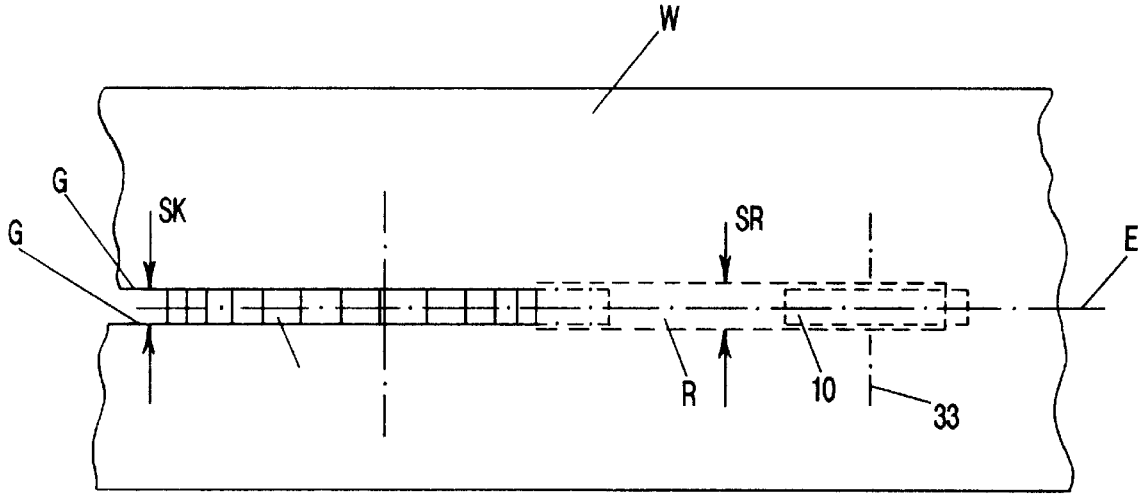
FIG. 2 a schematic plan view of a circular saw machine according to FIG. 1.

The rotational direction DR of the slitting tool 3 arranged upstream is counter to the rotational direction DK of the circular saw blade K. As shown in FIG. 2, the cutting width SR of the slitting saw blade 10 is matched to the cutting width SK of the circular saw blade K, preferably is slightly greater than the cutting width SK of the circular saw blade K. This ensures that the circular saw blade K upon performing a separation cut exits in the slitting groove R without cutting therein.

When changing the circular saw blade K, for example, when cutting a different material or when installing a new blade, the slitting saw blade 10 must be adjusted to the actual cutting width SK of the circular saw blade K. Accordingly, the slitting tool 3 is embodied according to the design represented in FIG. 3.

Figure 4:
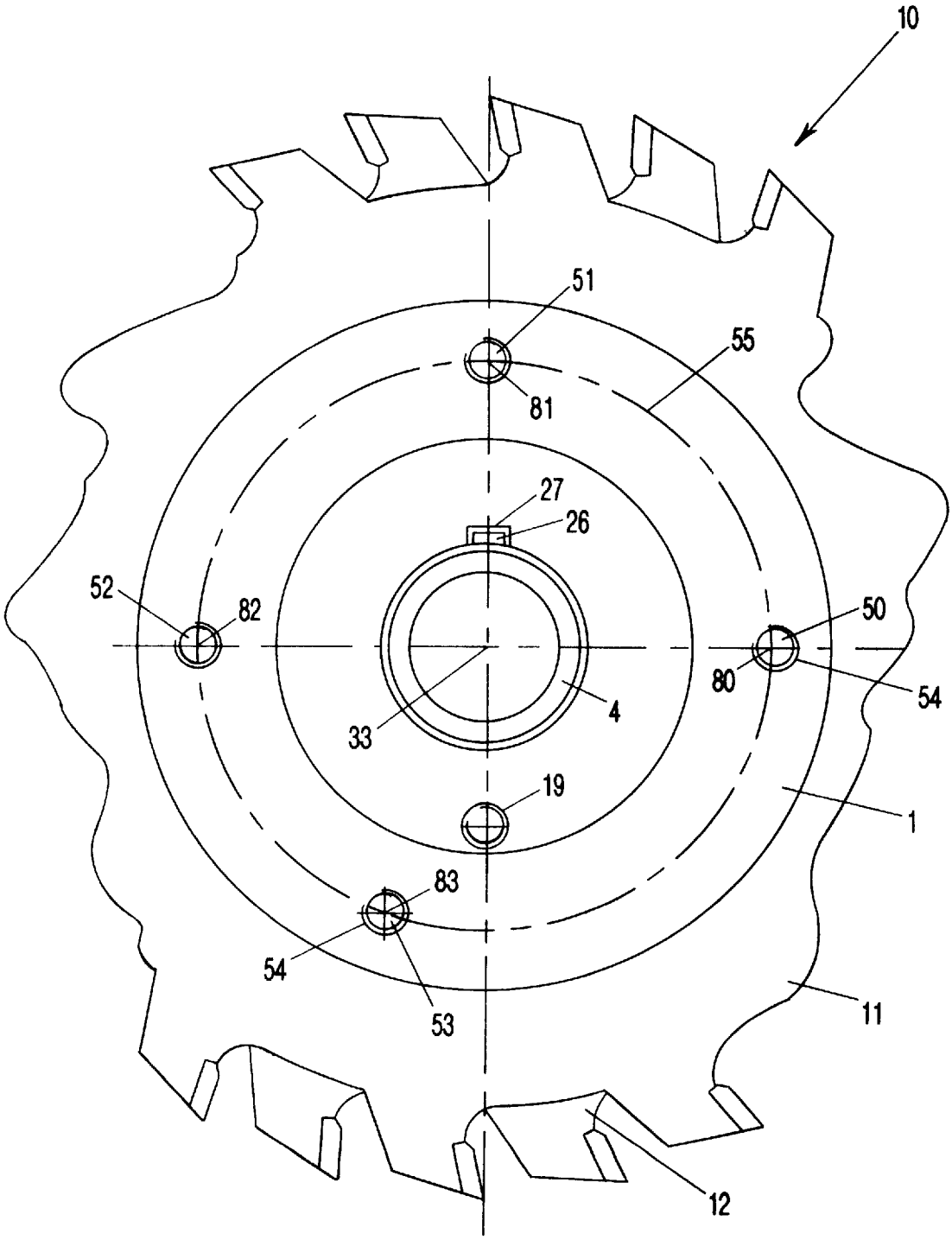
FIG. 4 a view of the slitting tool according to arrow Y in FIG. 3.

The slitting tool 3 is comprised substantially of two tool flanges 1 and 2 which form together the tool carrier 36. Each tool flange 1 and 2 representing approximately one half of the tool carrier 36 supports an annular blade half 11, 12 that form together the slitting saw blade 10. From the view shown in FIG. 4 it is obvious that the teeth of one blade half 11 in the rotational direction are positioned within the gaps between the teeth of the other blade half 12.

Figure 5:
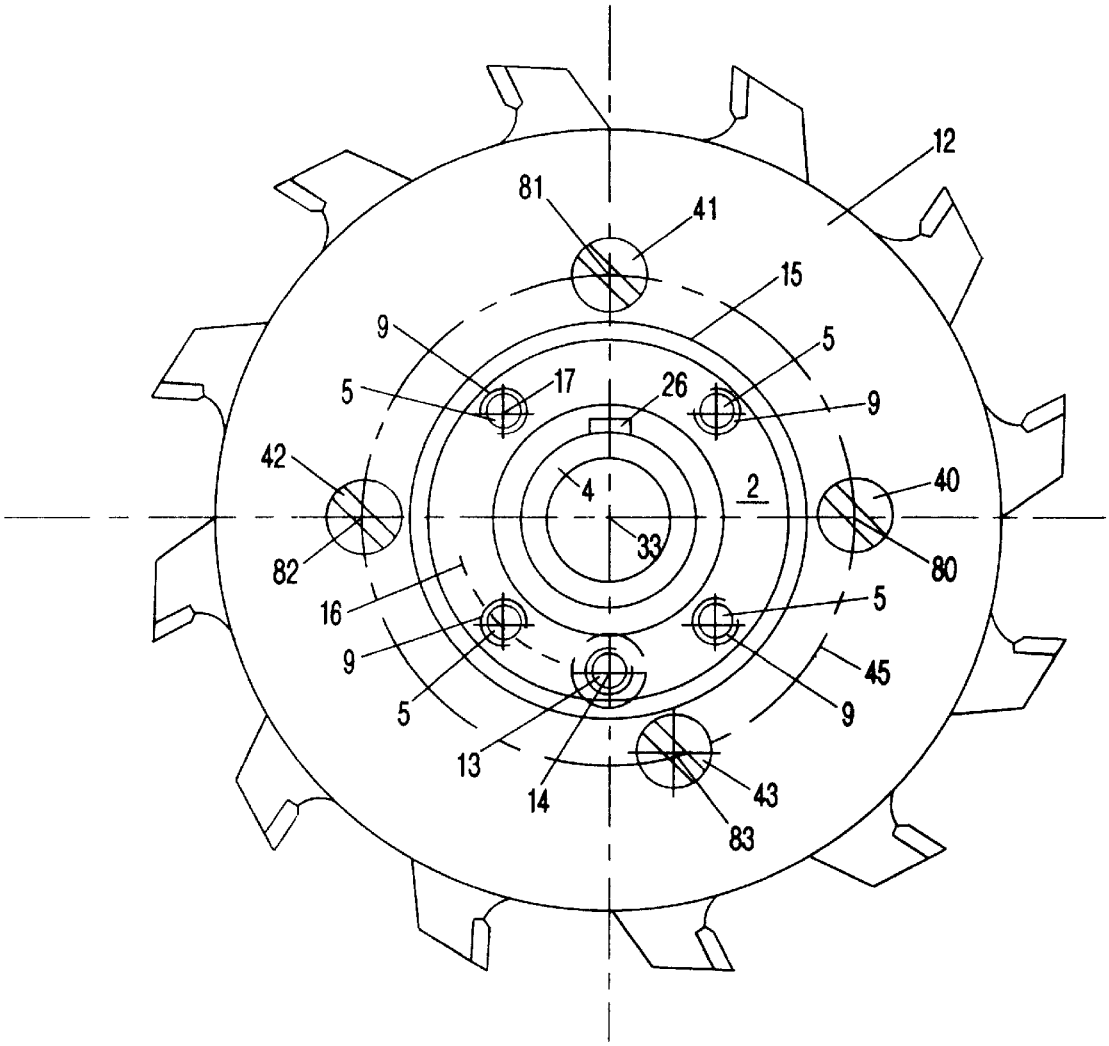
FIG. 5 a view of the inner side of a tool flange with a blade half connected thereto in a view according to arrow Y in FIG. 3.

The first tool flange 1 is axially displaceable on the hub 4 which is part of the second tool flange 2. In the shown embodiment the tool flange 2 and the hub 4 are separate components, which are preferably connected by screws 5 in a fixed manner. For this purpose, the hub 4 at one axial end is provided with an annular flange 6 which rests with its outer end face 7 facing away from the first tool flange 1 on the annular second tool flange 2. The hub 4 penetrates the second tool flange 2. Preferably, the annular flange 6 is received over the greater portion of its thickness d in a cutout 8 which is embodied in the radially inwardly positioned area of the outer end face 7 of the second tool flange 2. In the area of radial coverage of the annular flange 6 by the external end face 7 of the second tool flange 2, the screws 5 are arranged which engage the threaded bores 9 of the second tool flange 2. As can be seen in the view of FIG. 5, the screws 5, respectively their coordinated threaded bores 9, are uniformly distributed across the circumference of the radially symmetrical second tool flange 2. In the shown embodiment four screws 5, respectively, threaded bores 9 are distributed over the circumference with equidistant spacing relative to one another on a common circle 16.

Between the annular flange 6 and the outer end face 7 of the second tool flange 2, the end embodied as a head 21 of a threaded spindle 20 of the adjusting device 35 is positioned. The threaded spindle 20, embodied preferably as a threaded bolt or a screw spindle, is positioned parallel to the axis of rotation 33 of the slitting tool 3 and penetrates a thread-free axial bore 13 which is provided within the second tool flange 2. The bore axis 14 (FIG. 5) is positioned beneath the inner edge 15 of the blade half 12 supported at the inner end face of the second tool flange 2. It may be expedient to arrange the central axis 14 of the bore 13 on a common circle 16 on which the central axis 17 of the screws 5, respectively, of the threaded bores 9 are positioned. The bore 13 is positioned closer to the hub 4 than to the outer circumference 18 of the second tool flange 2.

Figure 3:
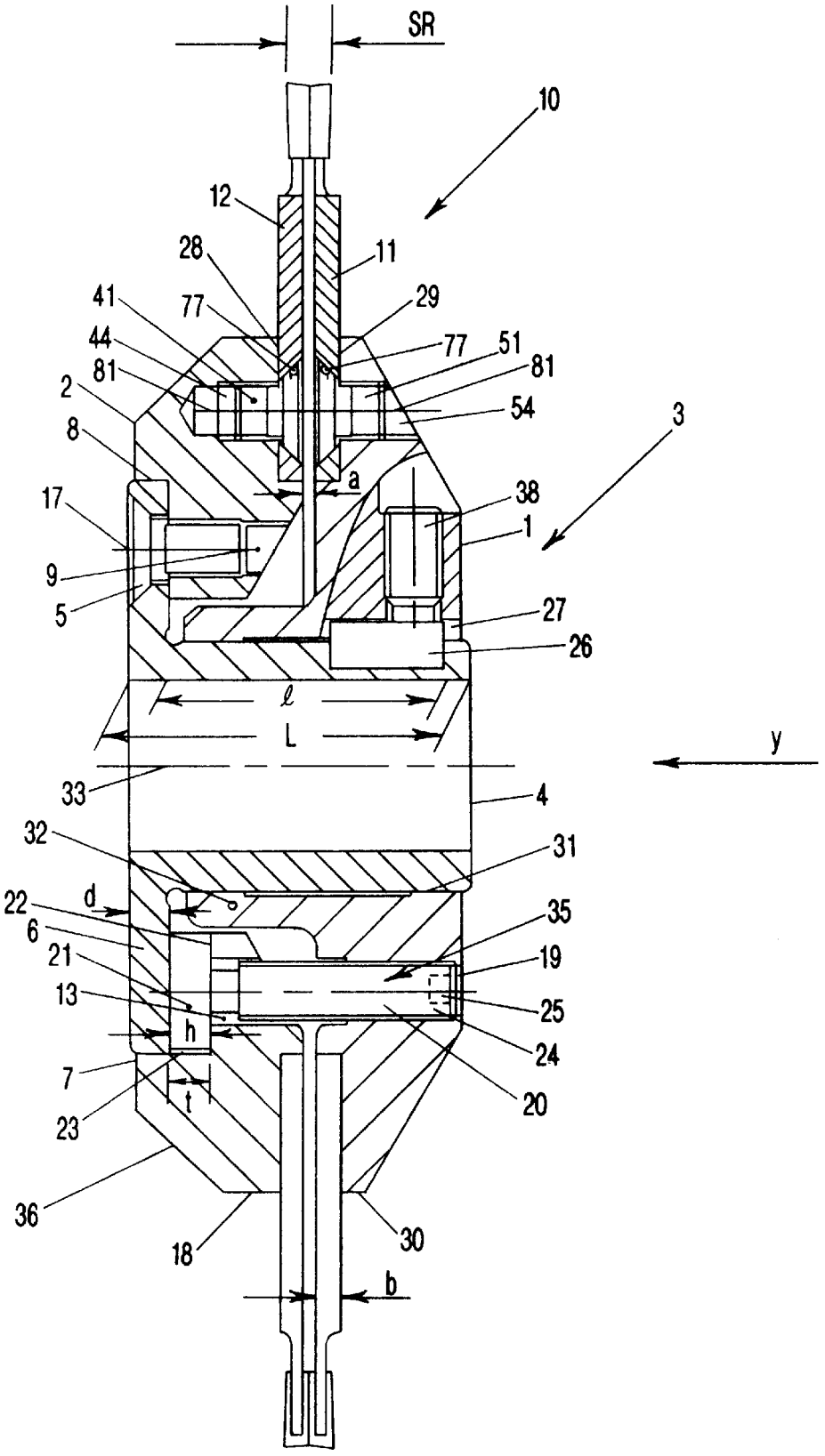
FIG. 3 a section of the inventive slitting tool comprised of a tool carrier and a slitting saw blade.

In the shown embodiment the head 21 of the threaded spindle 20 is substantially completely received in the cutout 23 whereby the annular surface of the head 21 rests on the bottom 22 thereof. As shown in FIG. 3, the depth t of the cutout 23 corresponds to the height h of the head 21. Preferably, the depth t is slightly greater so that the head 21 can be received axially substantially without play but so as to be rotatable between the second tool flange 2 and the ring (annular) flange 6 forming a cover disk (cover plate) of the hub 4. The threaded spindle 20 penetrates the thread-free bore 13 in the direction toward the first tool flange 1 and engages a threaded bore 19 which is embodied as an axial throughbore within the first tool flange 1 and extends parallel to the axis of rotation 33 coaxially to the bore 13. The end 24 of the threaded spindle 20 positioned within the threaded bore 19 has a receiving element 25 for engagement of a tool such as a wrench etc. so that with the aid of the tool the threaded spindle 20 can be easily rotated.

The base body of the first tool flange 1 is, as is the base body of the second tool flange 2, substantially of radial symmetry and has an outer circumference 30 that forms a common rotational surface with the outer circumference 18 of the second tool flange 2. The first tool flange 1 has an inner cylindrical receiving element 31 engaged by the hub in a substantially play-free and displacable manner. The axial length L of the hub 4 is thus longer than the axial length I of the inner sleeve-shaped receiving opening 31. Upon axial displacement on the hub 4 the distance a between the tool flanges 1 and 2, and thus the cutting width SR of the slitting saw blade 10, is adjustable. In order to provide guiding of the hub 4 that can withstand even great loads, the receiving opening 31 of the first tool flange 1 extends axially through the inner sleeve projection 32 which engages with radial play the annular second tool flange 2 and ends approximately at the distance a before the annular flange 6.

For providing a rotationally fixed connection of the two tool flanges 1 and 2, the hub 4 comprises a rotary follower 26 which engages the axial coupling groove 27 of the inner receiving opening 31 of first tool flange 1. The coupling groove 27 extends advantageously axially over the entire length of the receiving opening 31 and is open at both end faces of the first tool flange 1. The rotary follower 26 is preferably a part projecting radially past the outer circumference of the hub 4 and having an axially limited length. It is designed according to the loads to be expected. The rotary follower 26 can be a component separate from the hub 4 and the first tool flange 1 and is insertable into the external circumference of the hub 4 so as to be attached securely thereto.

At the end faces that face one another, the tool flanges 1 and 2 have positioned thereat a blade half 11, respectively, 12 of the slitting saw blade 10. The blade halves 11 and 12 are annular blades which are inserted into radially outwardly open cutouts 28 and 29 at the facing end faces of the respective tool halves 1 and 2. Preferably, the depth of the cutout 28 or 29 corresponds approximately to the thickness b of a respective blade half 11, 12.

Each blade half 11 and 12 is fastened with fastening (fasteners) means to the respective tool flange 1 and 2 in a rotationally fixed and axially fixed manner but so as to be exchangeable. In the shown embodiment the fastening (fasteners) means are threaded screws 40 through 43 and 50 through 53 which engage respective threaded bores 44 and 54 (FIG. 3) of the tool flanges 1 and 2.

Even though the base body of the tool flanges 1 and 2 is of radial symmetry, especially due to the embodiment of the threaded spindle 20 that forms the adjusting device 35, the tool carrier 36 has a non-uniform mass distribution over its circumference so that the slitting tool 3 in its completed arrangement comprised of the tool carrier 36 and the slitting saw blade 10 must be balanced. This required balancing is inventively produced with constructive means by selecting the position of the fastening (fasteners) means of the blade halves 11 and 12 along the circumference of the slitting tool 3 according to respective balancing criteria.

As shown in the embodiment of the blade half 12 represented in FIG. 5, fastening (fasteners) means in the form of screws 40 through 43 are provided for fastening on the tool flange 2 which, as shown in FIG. 3, engage threaded bores 44 of the tool flange 2. The threaded bores 44, respectively, the through openings 70 to 73 provided within the blade half 12 have central axis 80 through 83 extending parallel to the axis of rotation 33 so that they are arranged about the circumference on a common circle 45. The central axes 80 to 82 of the fastening means are positioned equidistantly at distance m relative to one another in the circumferential direction (FIG. 7), while the central axis 83 is positioned relative to the central axis 82 at a greater distance m2 and to the neighboring central axis 80 at a smaller distance ml. The position of the fastening (fasteners) means or central axis 83 on the circle 45 and, if required, radially to the axis of rotation 33 of the slitting tool 3 is determined by the balancing criteria of the complete arrangement. The fastening means (screw 43, opening 73, threaded bore 44—FIG. 5) securing the blade half 12 on the tool flange 2 forms a constructive imbalancing weight for the entire arrangement of the slitting tool 3.

Figure 6:
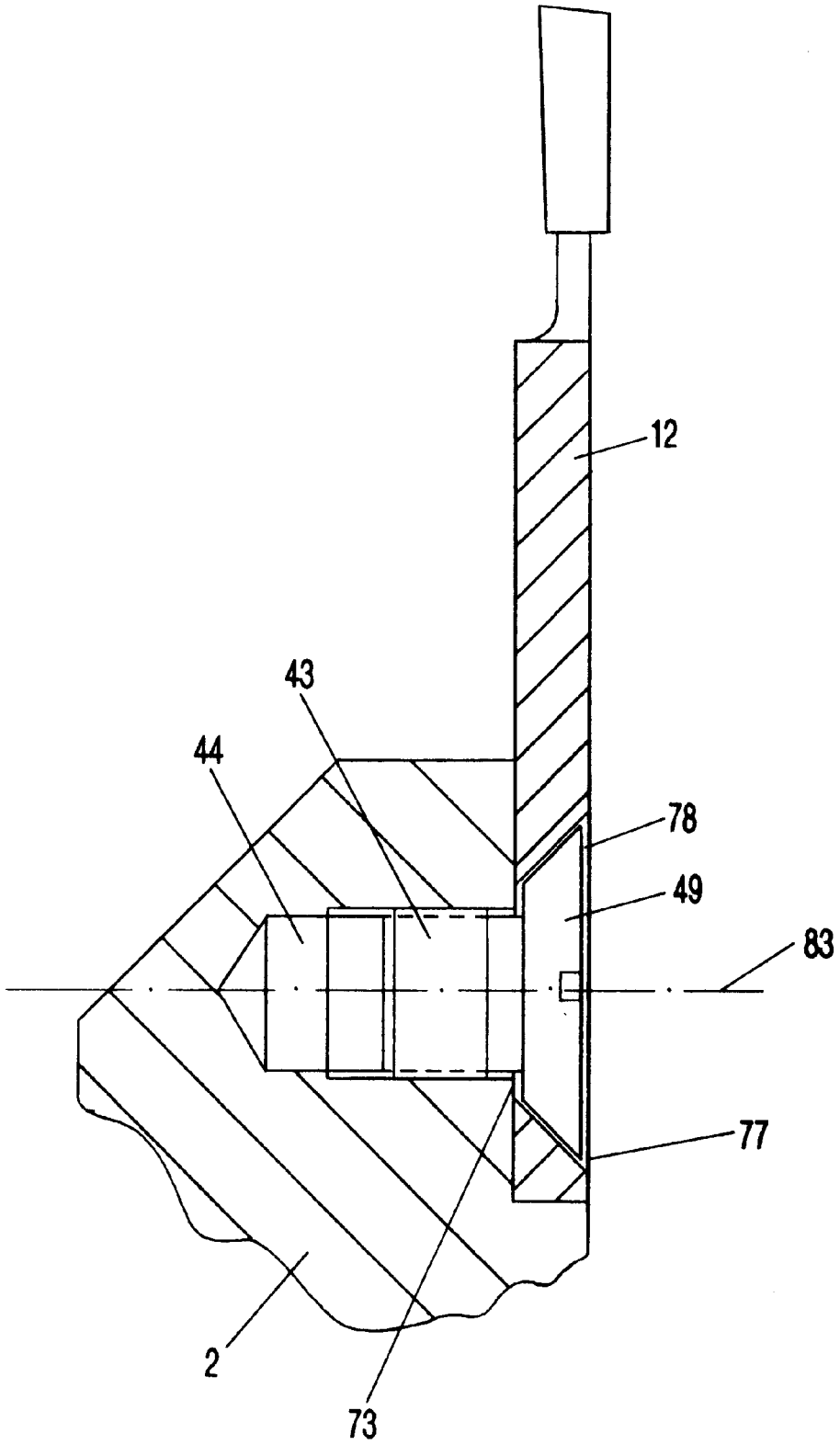
FIG. 6 in an enlarged representation a fastening means for arrangement of a blade half on the tool flange.

As is shown in the enlarged representation according to FIG. 6, the threaded bore 44 is longer than the screw 43. Since the blade half 12 is secured about its circumference with a plurality, preferably four, screws 40 to 43 to the tool flange 2, four threaded bores 44 are distributed over the circumference of the tool flange 2 which are only partly filled by the respective screw 40 to 43. This, however, results in that the remaining material removal of the threaded bore 44 at the location of the screw 43 (FIG. 5) can compensate the material accumulation resulting from the adjusting device 35 when the threaded bore 44 of the screw 43 is positioned with different spacing m1 and m2 (FIG. 7) to the neighboring threaded bores 44 of the screw 40 and 42 (FIG. 5). The threaded bores 44 of the fastening means which are inventively asymmetrically arranged relative to the rotary axis 33 thus result in a balancing action of the tool carrier 36.

A further contribution for balancing the slitting tool 3, i.e., the entire arrangement of the tool carrier 36 and of the slitting saw blade 10, is provided by the through openings 70 to 73 of the blade halves 11 and 12 (FIG. 7) distributed asymmetrically about the circumference relative to the axis of rotation 33. These through openings 70 to 73 are congruent to the threaded bores 44 within the tool flange 1 and 2. As shown in FIG. 6 with the example of screw 43, the screws have a countersunk head 49 which is positioned in the cutout 77 of the through opening 73. The countersunk head 49 fills the cutout 77 only partly. Thus, a free space 78 remains which may correspond to the material removal required for balancing. Each blade half 11 and 12 thus provides for further balancing of the complete arrangement of the saw blade 10 and the tool carrier 36.

Figure 7:
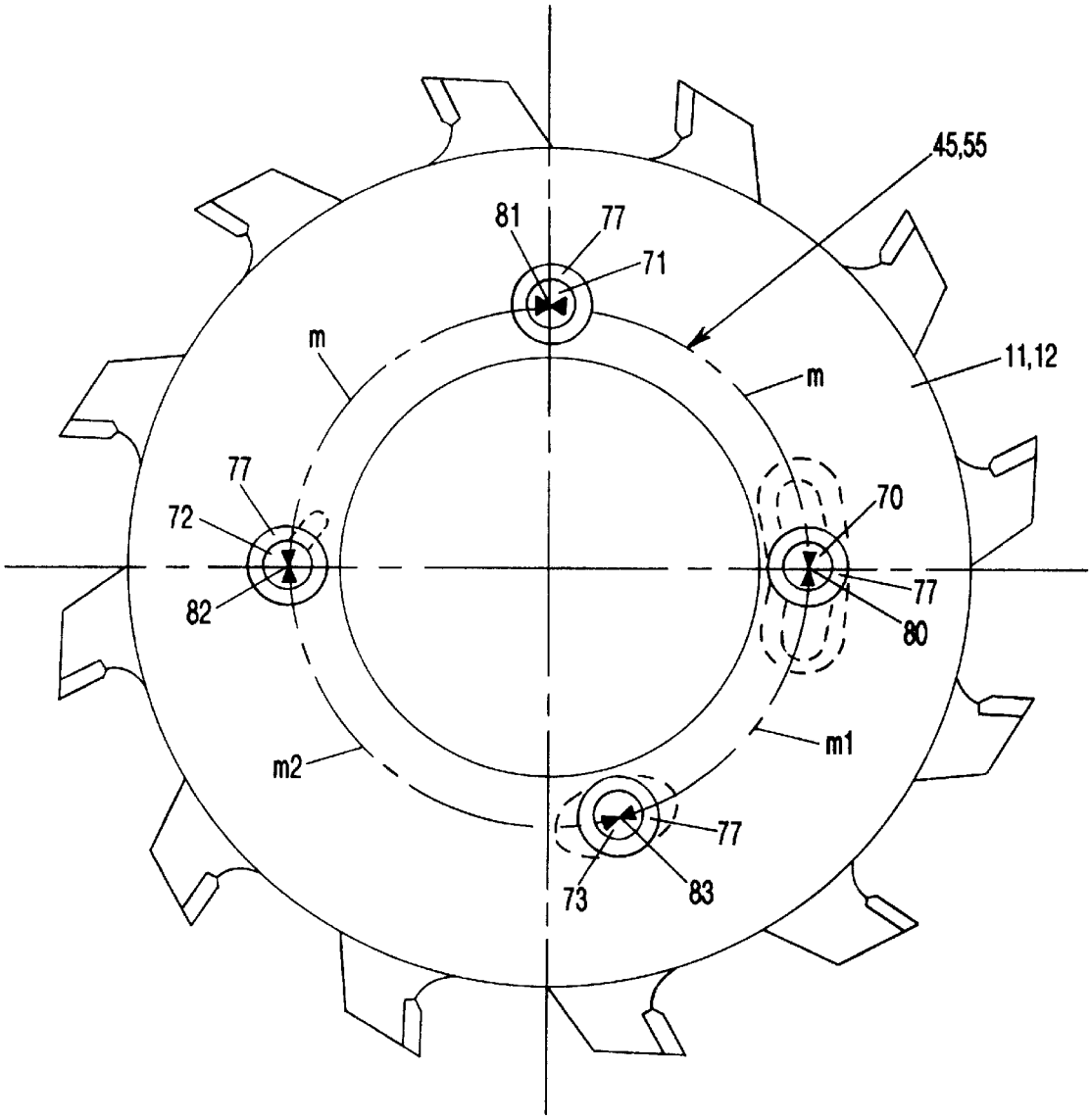
FIG. 7 a view of a blade half of the slitting saw blade.

In order to provide a possibly required further material removal for balancing, one or more through openings can have a design that deviates from a circular shape. The example of the through opening 73 in FIG. 7 shows a kidney-shaped or elliptical shape in a dashed line. Also, a slot-shaped opening can be expedient, as is illustrated in FIG. 7 at the location of the opening 70 in a dashed line. Also, bayonet-shaped embodiments of the opening are possible, as indicated at the opening 72. The radial slot provided at the edge of the opening 72 can have a suitable length, width, and position and can extend especially over the entire axial length of the through opening.

The slitting tool 3, which is balanced due to the selected asymmetrical arrangement of the fastening means for the blade halves 11 and 12, is slipped with a sleeve-shaped hub 4 onto the drive shaft is axially secured thereat. The axial clamping is provided between the end faces of the hub 4 so that the second tool flange 2 is secured axially at the machine while the first tool flange 1 is axially displacable on the hub 4. Preferably, the hub 4 thus projects for a maximum distance a, i.e., for a maximum cutting width SR (FIG. 3), slightly from the first tool flange 1. For adjusting the cutting width SR of the slitting saw blade 10, the threaded spindle 20 is rotated by engagement by a tool inserted into the receiving opening 25 of the threaded spindle that is accessible from the exterior. The threaded spindle 20, which is rotatably supported but axially fixed within the tool flange 2, causes an axial displacement of the first tool flange 1 on the hub 4 as a function of the pitch of the thread so that the cutting width SR can be adjusted. In the embodiment according to FIG. 1, the maximum possible cutting width SR is represented. Once the desired cutting width has been adjusted, a securing screw 38 which is radially threaded into the first tool flange 1 is tightened so that it acts onto the rotary follower 26 of the hub 4 and effects radial clamping for axially securing the tool flange 1 on the hub 4. The securing screw 38 is provided as an additional securing means. When the thread of the threaded spindle 20 is selected so as to have a flat pitch angle, an additional securing is in general not necessary.

In the shown embodiment the threaded spindle 20 is positioned in a thread-less bore 13 of the second tool flange 2. It may be expedient to embody the bore 13 as a threaded bore and to provide the threaded spindle with a right handed thread on one half and a left-handed thread on the other half.

Upon rotation of the threaded spindle an adjusting stroke then is performed within the bore 13 as well as within the bore 19 with which the distance a of the two tool flanges 1 and 2 and thus the cutting width SR of the slotting saw blade 10 can be changed. In such a design the pitch of the thread can be selected to be very flat so that a fine adjustment insensitive with respect to axial forces can be provided by the adjusting device 35.

The fastening means (screw 43, 53) that is positioned asymmetrically about the circumference relative to the other fastening means, is preferably adjacent to the adjusting device 35, respectively, its threaded bore 20. It may be advantageous in this context, for further balancing of the complete arrangement, to provide the threaded bores 44, 54 with different excess length relative to the screws 40 to 43, 50 to 53. The excess length can be determined according to the location of the fastening means with respect to the required material removal for the purpose of balancing. It may be sufficient for a symmetrical arrangement of the fastening means to generate balancing of the complete arrangement exclusively via the design of the excess lengths of the threaded bores.

The present invention is, of course, in no way restricted to the specific disclosure of the specification and drawings, but also encompasses any modifications within the scope of the appended claims.

We claim:

1. Slitting tool for a circular saw machine, said slitting tool comprising:

a tool carrier consisting of a first tool flange and a second tool flange arranged coaxially and axially displaceable relative to one another;

a slitting saw blade comprised of a first and second blade halves;

fasteners for fastening said first blade half in a detachable manner to said first tool flange and for fastening said second blade half in a detachable manner to said second tool flange;

said fasteners distributed in a circumferential direction about said tool carrier;

an adjusting device arranged within said first and second tool flanges and connecting said first and second tool flanges to one another;

at least one of said fasteners arranged in an asymmetrical position relative to others of said fasteners for balancing said slitting tool, wherein said asymmetrical position is determined according to balancing criteria.

2. Slitting tool according to claim 1, wherein said fasteners have a central axis and said central axes are positioned on a common circle about an axis of rotation of said slitting tool, wherein said central axis of said at least one fasteners is positioned at a different spacing to said central axes of neighboring ones of said fasteners.

3. Slitting tool according to claim 1, wherein:

said fasteners are screws;

said blade halves have through openings;

said tool flanges have threaded bores;

said screws penetrate said through openings and engage said threaded bores.

4. Slitting tool according to claim 3, wherein:

said screws have a countersunk head;

said through openings have a cutout;

said countersunk heads are positioned in said cutouts of said through openings.

5. Slitting tool according to claim 4, wherein said cutouts are greater than said countersunk heads received therein.

6. Slitting tool according to claim 2, wherein:

said fasteners of said first blade half are positioned opposite said fasteners of said second blade half; and said central axes of said fasteners positioned opposite one another coincide.

7. Slitting tool according to claim 1, wherein said second tool flange has a hub and said first tool flange is axially displaceably secured on said hub.

8. Slitting tool according to claim 7, wherein said hub has a rotary follower and wherein said rotary follower engages said first tool flange.

9. Slitting tool according to claim 7, wherein said hub and said second tool flange are separate components whereby said hub has a ring flange resting at an outer end face of said second tool flange and is fastened to said outer end face.

10. Slitting tool according to claim 7, wherein:

said adjusting device is a threaded spindle;

said second tool flange has a thread-free bore;

said threaded spindle penetrates said thread-free bore of said second tool flange in a direction toward said first tool flange;

said threaded spindle is rotatable in said thread-free bore and is threaded into said first tool flange.

11. Slitting tool according to claim 10, wherein said threaded spindle has a head and wherein said head rests at an outer end face of said second tool flange facing away from said first tool flange.

12. Slitting tool according to claim 11, wherein said second tool flange has a cover plate and wherein said head is secured rotatably but without play between said cover plate and said outer end face.

13. Slitting tool according to claim 12, wherein said cover plate is an annular flange of said hub.

14. Slitting saw blade for a slitting tool of a circular saw machine, wherein the slitting tool comprises two tool flanges axially displaceably connected to one another by an adjusting device, said slitting saw blade comprising:

two blade halves each having through openings distributed in a circumferential direction of said saw blade for allowing penetration by fasteners with which each one of said blade halves is securable on one of the two tool flanges of said slitting tool, wherein, for balancing said slitting tool, at least one of said through openings in one of said blade halves is positioned in an asymmetrical position relative to the other one of said through openings of said one blade half, wherein said asymmetrical position is determined according to balancing criteria.

15. Slitting saw blade according to claim 14, wherein said through openings are provided with a cutout at a side facing away from said tool flanges for receiving a head of the fasteners, whereby said cutout is at least slightly greater than the head.

16. Slitting saw blade according to claim 14, wherein said through openings are positioned on a common circle about an axis of rotation of said slitted saw blade and at least one through opening is positioned at a different spacing to neighboring ones of said through openings.

17. Slitting saw blade according to claim 14, wherein said through openings have a non-circular cross-sectional contour.

18. Slitting saw blade according to claim 17, wherein said non-circular cross-sectional contour is slot-shaped, elliptically shaped or bayonet-shaped.

19. Slitting tool for a circular saw machine, said slitting tool comprising:

a tool carrier consisting of a first tool flange and a second tool flange arranged coaxially and axially displaceable relative to one another;

a slitting saw blade comprised of a first and second blade halves;

fasteners for fastening said first blade half in a detachable manner to said first tool flange and for fastening said second blade half in a detachable manner to said second tool flange;

said first and second tool flanges having bores for receiving said fasteners;

said fasteners and bores distributed in a circumferential direction about said tool carrier;

an adjusting device arranged within said first and second tool flanges and connecting said first and second tool flanges to one another;

at least one of said bores arranged in an asymmetrical position relative to others of said bores, wherein said at least one bore is longer than one of said fasteners received therein for balancing said slitting tool, wherein said asymmetrical position is determined according to balancing criteria.

* * * * *